United States Patent [19]

Davison et al.

[11] Patent Number: 4,742,766

[45] **Date of Patent: * May 10, 1988**

[54] DYNAMICALLY BALANCED EXHAUST PIPE CAP

[76] Inventors: Jerome G. Davison, 3361 Stoneybrook, Oklahoma City, Okla. 73120; Gerald E. Hollingshead, 7609 NW. 34th St., Bethany, Okla. 73008

[ * ] Notice: The portion of the term of this patent subsequent to May 26, 2004 has been disclaimed.

[21] Appl. No.: 19,632

[22] Filed: Feb. 27, 1987

Related U.S. Application Data

[63] Continuation-in-part of Ser. No. 862,131, May 12, 1986, Pat. No. 4,667,582.

[51] Int. Cl.[4] ..... F23L 17/02

[52] U.S. Cl. ..... 98/59

[58] Field of Search ..... 98/59, 71, 73, 74, 77, 98/119, 122

[56] References Cited

U.S. PATENT DOCUMENTS

| | | | |
|---|---|---|---|
| 1,291,184 | 1/1919 | Schulz | 98/59 |
| 1,720,789 | 7/1929 | Heusser | 98/59 |
| 1,944,321 | 1/1934 | Huxter | 98/74 X |
| 2,396,876 | 3/1946 | Olsen | 98/73 |
| 2,494,016 | 1/1950 | Taylor | 98/59 |
| 2,508,615 | 5/1950 | Lukes | 98/59 |
| 2,983,216 | 5/1961 | Stade et al. | 98/59 |
| 3,363,537 | 1/1968 | De Penning | 98/59 |
| 3,446,010 | 5/1969 | Hopkins | 60/29 |
| 3,523,499 | 8/1970 | Bauerschmidt | 98/59 |
| 3,788,072 | 1/1974 | Burger | 60/324 |
| 3,964,376 | 6/1976 | Janke | 98/59 |

FOREIGN PATENT DOCUMENTS

| | | | |
|---|---|---|---|
| 135217 | 8/1982 | Japan | 98/59 |
| 648119 | 12/1950 | United Kingdom | 98/59 |

*Primary Examiner*—Harold Joyce

*Attorney, Agent, or Firm*—Laney, Dougherty, Hessin & Beavers

[57] ABSTRACT

A dynamically balanced exhaust pipe cap which includes an elongated tubular member having an upper end defined by an upper edge lying in a plane extending at an acute angle to the longitudinal axis of the tubular member. A closure flap assembly is pivotally secured to the upper end of the tubular member and includes a closure plate having a pair of balancing plates which extend downwardly from the closure plate on opposite sides of the tubular member. A pair of wind vanes are secured to the two balancing plates.

15 Claims, 2 Drawing Sheets

DYNAMICALLY BALANCED EXHAUST PIPE CAP

RELATED APPLICATION

This application is a continuation-in-part of U.S. patent application Ser. No. 862,131 filed on May 12, 1986, now U.S. Pat. No. 4,667,582, and entitled "DYNAMICALLY BALANCED EXHAUST PIPE CAP".

FIELD OF THE INVENTION

This invention relates to pivotally mounted caps of the type used for closing the atmospheric opening of an exhaust pipe at a time when exhaust gas is not being vented therethrough, and more particularly, to a dynamically balanced closure cap for an exhaust pipe, which cap is geometrically so configured, and has its mass so distributed, that it functions effectively and resists counteractive wind and gravity forces.

BACKGROUND OF THE INVENTION

1. Brief Description of the Prior Art

Efforts to provide better dynamic balancing in caps for diesel engine exhaust pipes have taken various forms. Thus, in Stade et al U.S. Pat. No. 2,983,216, a rain cap for an engine exhaust pipe is provided, and this cap is of the gravity actuated-type in which the cover member is adapted to fit over the open end of the stack or exhaust pipe, and carries a counter-balancing section or portion which is pivotally supported in a way and at a location such that the cap tends, by reason of the shift of the center of gravity, to reseat or close when the exhaust gases are not acting on the cap to open it. This cap is susceptible, however, to opening under wind pressure, or the pressure of air developed as the tractor upon which the cap is mounted is carried over the road on a transport vehicle if the cap is faced in an improper direction. In the full closed position, the cap extends horizontally across the upper end of the exhaust pipe, and it is therefore necessary for the cap to open through almost 90° in order for it to achieve a fully open position. This requires the exertion of a greater opening force from the exhaust gases which are being vented through the exhaust pipe, and can result in an undesirably high level of back pressure being exerted on the exhaust gases attempting to pass through the exhaust pipe.

Bauerschmidt U.S. Pat. No. 3,523,499 discloses a weather cap construction for an exhaust pipe. The weather cap is held on the exhaust pipe by a collar which is closed about the exhaust pipe by a suitable clamping bolt. In the Bauerschmidt cap, the pivoted closure element is supported for pivotation about a pivotal axis which is displaced laterally from the vertical axis of the exhaust pipe by a substantial distance, and when the cap is in its elevated, fully opened position, it exerts essentially no back pressure on the gases passing from the exhaust pipe. It must, however, open through an angle which is almost 90°, and therefore in the initial phase of the opening arc, an undesirable amount of back pressure may be exerted on the exhaust gases. A positive stop is provided to limit how far the crank upon which the closed cap is carried will open in its full open position, and this positive stop is in a position such the center of gravity still remains inside the pivotal axis. The crank arm will therefore fall, under the influence of gravity, to a closed position, once the exhaust gases cease to be vented through the exhaust pipe.

In De Penning U.S. Pat. No. 3,363,537, a tractor exhaust pipe cover is illustrated and described. The cover depicted includes a cap which pivots into, and away from, a horizontal plane representing the position of closure of the cap. The cap carries reflector devices in the form of a pair of plate like reflectors mounted on the opposite side of the pivotal axis of the cap structure from the cap plate proper. These reflectors afford some weight which assists the cap in opening in response to the force exerted by the upwardly moving exhaust gases.

Other types of exhaust cap structures are those which are depicted and described in Taylor U.S. Pat. No. 2,494,016; Burger U.S. Pat. No. 3,788,072 and Lukes U.S. Pat. No. 2,508,615.

2. Brief Description of the Present Invention

The present invention is an improved, dynamically balanced protective cap which is useful on the exhaust pipes of diesel engines for the purpose of preventing dust, debris and rain from entering the exhaust pipe, and thereby fouling the engine or preventing smooth running of the engine. The protective cap also is constructed so that the engine is protected from wind force acting deleteriously upon any turbocharger that may be a part of the engine, and be accesible to the down draft of wind entering the exhaust pipe and proceeding downwardly toward the engine.

The protective cap of the invention includes a tubular element by which the cap assembly in its entirety is secured to a pipe which projects in a vertical direction from a diesel engine for the purpose of venting engine exhaust gases to the atmosphere. A closure flap assembly is pivotally secured to the tubular element for pivotation about a horizontal axis in undergoing opening and closing movement with respect to the exhaust pipe upon which the protective cap is mounted. The tubular element is cut through at an angle or on a bias, so that the opening at the upper end of the exhaust pipe is angulated with respect to the vertical. Because of this, a closure plate which forms a part of the closure flap assembly can lie at an angle against the upper edge of the exhaust pipe which surrounds the discharge opening, and this closure plate need only open through an angle of about 40° to achieve its fully open position. This aids in obviating the development of undesirable back pressure in the pipe and at the exhaust port of the engine at a time when the engine is running and exhaust gases are being vented through the pipe past the closure plate.

The closure plate has a pair of parallel balancing plates secured to the opposite sides of the closure plate and located on opposite sides of the tubular element. These balancing plates preferably lie in spaced parallel planes. The parallel balancing plates function to aid in distributing the weight and in translating the center of gravity of the moveable closure flap assembly in such way that the closure flap can be easily opened and easily closed when the exhaust gases terminate their flow through the exhaust pipe. Each of the parallel balancing plates carries a bearing sleeve which receives a stub axle, or other pivotal support element, which is secured to the tubular element. A pair of horizontally spaced, monoplanar wind vanes are secured to aligned edges on the two balancing plates, and each preferably extends normal to the respective balancing plate, with the two wind vanes preferably located in coplanar alignment with each other.

The dynamically balanced protective cap of the invention, as thus constructed, avoids chattering caused by rapidly opening and closing in a cylical motion at a time when the engine is running, and exhaust gases are being vented through an exhaust pipe carrying the cap.

Another important object of the invention which is achieved by the structure utilized is the obviation of opening of the pivoted closure flap assembly under the force developed by an artifical or natural air movement developed either when the engine upon which the protective cap is mounted is standing stationary, or is being towed by means of an over-the-road vehicle.

An additional object of the invention is to provide a dynamically balanced protective cap for mounting on an exhaust pipe of a diesel engine, which cap requires relatively little movement to move from its full closure position to a fully opened position, and requires relatively little exhaust gas pressure in order to achieve this opening, thereby reducing the propensity of such caps to cause an undesirable back pressure acting downwardly through the exhaust pipe to the location of the exhaust ports of the engine.

A further object of the invention is to provide a dynamically balanced protective cap for the exhaust pipe of a diesel engine, which cap is characterized in having relatively few moving parts, and in having a relatively long and trouble free operating life.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
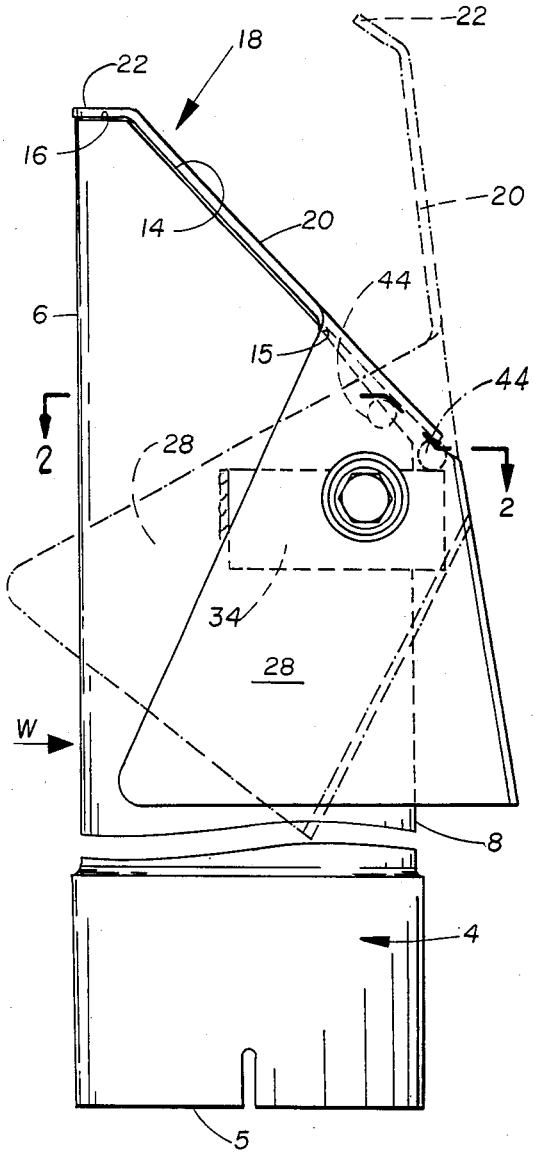
FIG. 1 is a side elevation view of the dynamically balanced exhaust pipe cap of the invention. The open position of the exhaust pipe cap is illustrated by the use of a dashed line.

The dynamically balanced exhaust pipe cap of the invention includes a tubular element 4, which, in the illustrated embodiment, is cylindrical in configuration. The tubular element 4 is open at its lower end 5 so that it can be slipped over the top of an exhaust pipe (not shown). The exhaust pipe can typically be any of those types of tubular elements used to vent exhaust gases from a diesel engine. The tubular element has a forward side 6 and a rear side 8.

The tubular element 4 is cut through at its upper end generally along a plane which extends at an acute angle to the longitudinal axis of the tubular element, and thus terminates in an angulated bias cut which defines an oval-shaped opening at the upper end of the tubular element. The upper edge of the tubular element 4 developed by this cut actually includes two portions lying in two slightly angulated planes, with a first portion, shown in FIGS. 1 and 3, and denominated by reference numeral 14. Breaking away from this first upper edge portion 14 into a slightly steeper angle, so as to lie in a plane extending at an angle, X, of from about 5° to about 10° with respect to the plane which contains the first upper edge portion 14, is a second portion of the upper edge, which second portion is identified by reference numeral 15. The reason for this angulation of the edge portion 14 with respect to the edge portion 15 will subsequently be explained.

Figure 6:
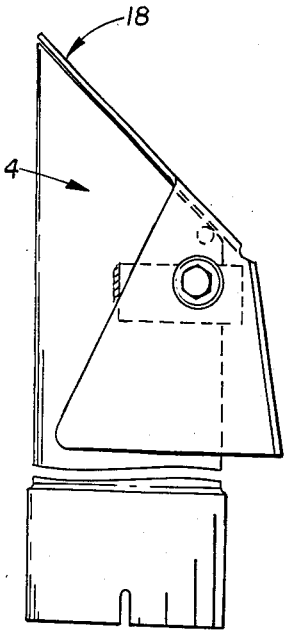
FIG. 6 is a fragmentary detail of the upper portion of the dynamically balanced exhaust pipe cap of the invention, and illustrating a portion of a modified embodiment of the invention.

In the embodiment of the invention illustrated in FIGS. 1–5, the first upper edge 14 intersects at its upper end, a third portion 16 of the upper edge, which third portion lies in a substantially horizontal plane and is coextensive with a segment of a circle. In a different embodiment of the invention, the first upper edge portion 14 extends completely to the forward side of the tubular element portion 4 so that it defines a complete oval, and so that there is no portion of the upper edge which lies in a horizontal plane. Such alternate embodiment of the invention is depicted in FIG. 6.

Figure 3:
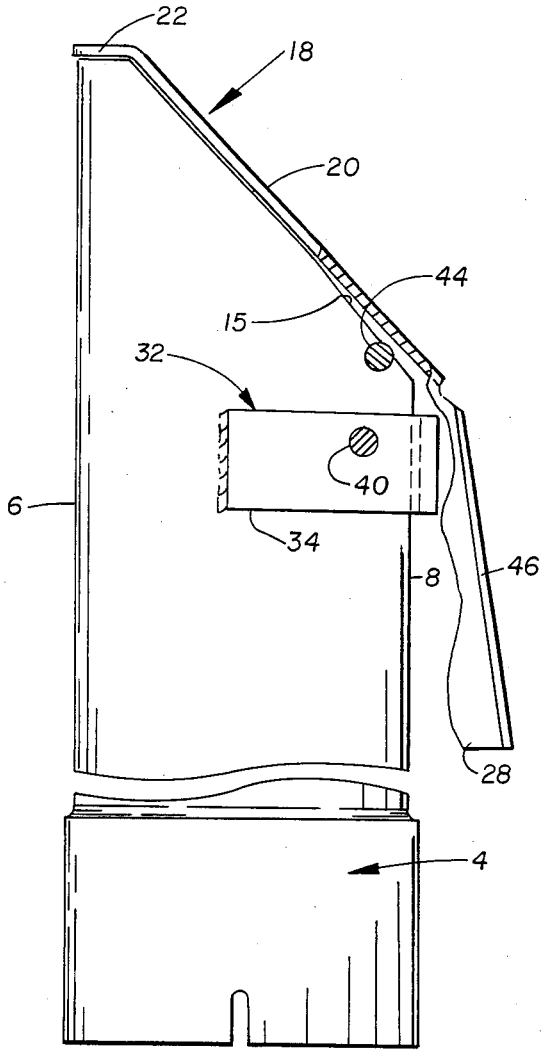
FIG. 3 is a sectional view of a dynamically balanced exhaust pipe cap of the invention taken along line 3—3 of FIG. 2, with parts of the exhaust pipe cap illustrated in elevation, and a part broken away for clarity of illustration.
Figure 4:
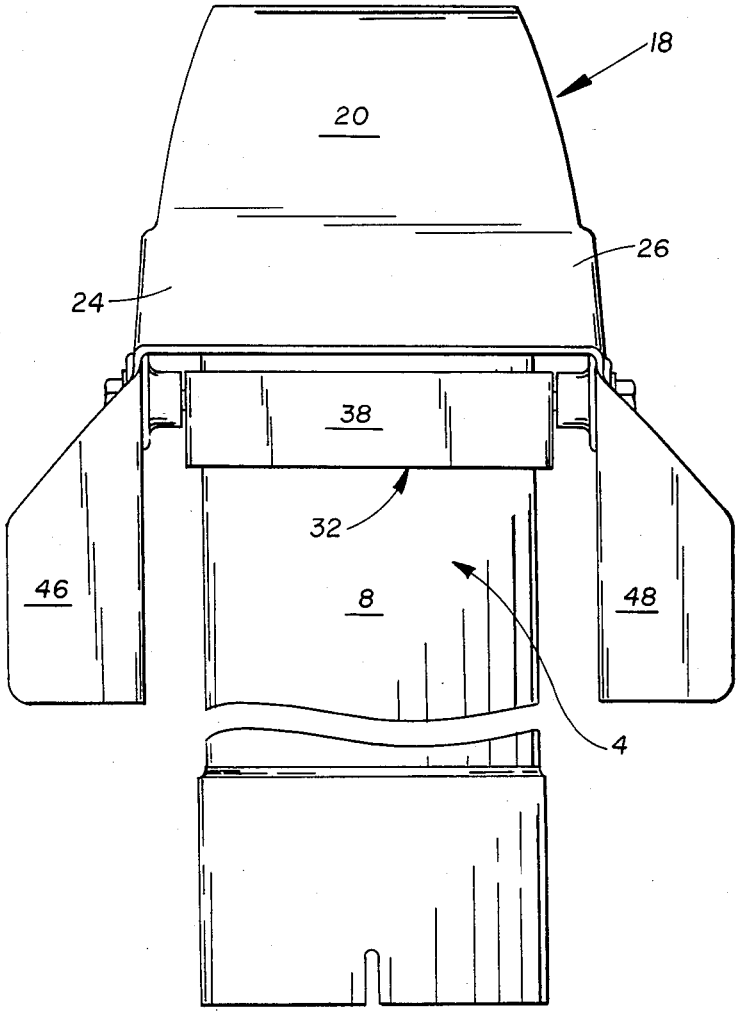
FIG. 4 is an elevation view of the dynamically balanced exhaust pipe cap of the invention as it appears when viewed after rotation through ninety degrees from the position depicted in FIGS. 1 and 3.
Figure 5:
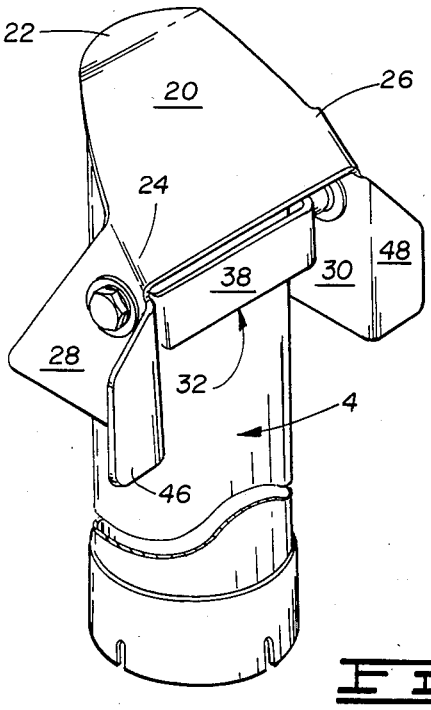
FIG. 5 is a perspective view of the dynamically balanced exhaust pipe cap depicted in FIG. 1.

The dynamically balanced protective cap of the invention further includes a closure flap assembly designated generally by reference numeral 18. The closure flap assembly 18 includes a closure plate 20 which is most clearly illustrated in FIGS. 3 and 5. In the embodiment of the invention shown in FIGS. 1–5, the closure plate 20 includes a horizontally extending lip 22 located and configured to lie against the third or forward upper edge portion 16 of the tubular element 4, as shown in FIGS. 1, 3 and 5. The closure plate 20 is also characterized in having a pair of opposed, lateral flanges 24 and 26 disposed at the opposite sides of the rear portion of the cover plate as shown in FIG. 4.

A pair of downwardly extending, trapezoidally-shaped balancing plates 28 and 30 are secured along their upper edges to the respective lateral flanges 24 and 26. The balancing plates 28 and 30 extend in spaced, parallel planes, and are disposed on opposite sides of the tubular element 4. Further, each of the balancing plates 28 and 30 preferably lies in a plane which extends normal to the plane of the principal portion of the closure plate 20.

Figure 2:
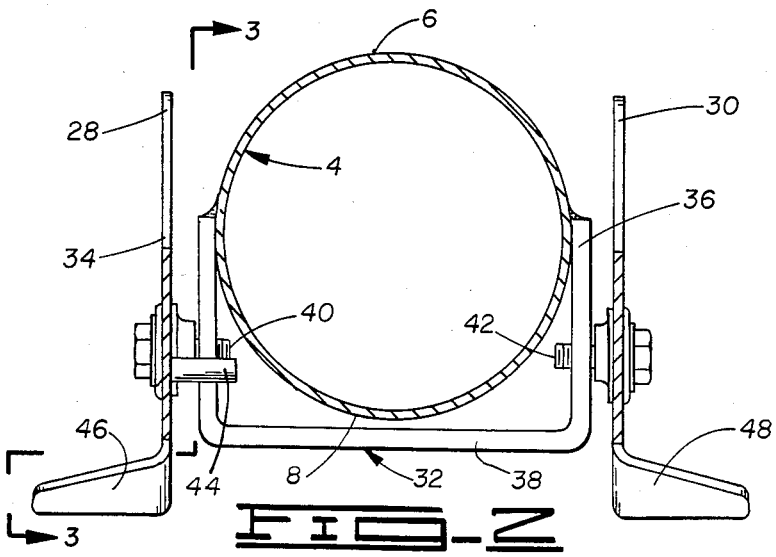
FIG. 2 is a sectional view taken along line 2—2 of FIG. 1.

In order to pivotally mount the closure flap assembly 18 on the tubular element 4, a U-shaped mounting and arresting bracket 32 is welded to the outer periphery of the tubular element 4 as shown in FIG. 2. The arresting bracket 32 includes a pair of parallel legs 34 and 36 joined to the opposite ends of a web portion 38 which projects across the tubular element 4 at the rear side thereof. The legs 34 and 36 are welded, or otherwise suitably secured, to the opposite sides of the tubular element 4.

A pair of threaded stub axles 40 and 42 function as pivotal axles used for mounting the closure flap assembly 18 upon the arresting bracket 32. The pivotal stub axles 40 and 42 extend through the respective legs 34 and 36 of the bracket 32, and through the downwardly extending, trapezoidally-shaped balancing plates 28 and 30.

In order to limit the distance that the closure flap assembly 18 can pivot and move into an open position, a movement limiting stud 44 is secured to the inner side of the downwardly extending trapezoidally-shaped balancing plate 28. The position of the stud 44 is most clearly illustrated in FIGS. 2 and 3 of the drawings. When the closure flap assembly 18 undergoes pivotation to an open position to permit the exhaust gases to be discharged from the upper end of the tubular element 4, the distance that the closure plate 20 can open is limited by contact of the stud 44 with the web portion 38 of the bracket 32.

The closure flap assembly 18 further includes a pair of spaced, co-planar wind vanes 46 and 48 which are secured to the respective aligned rear edges of the two balancing plates 28 and 30, as shown in FIGS. 2, 4 and 5. The wind vanes project in a direction away from the tubular element 4.

OPERATION OF THE INVENTION

In using the dynamically balanced exhaust pipe cap of the invention, the cap is first mounted on a tubular exhaust pipe by telescoping the tubular element 4, into or around the exhaust pipe of the vehicle upon which the exhaust pipe cap is to be mounted. The manner in which this is accomplished is illustrated in United States Patent Application Ser. No. 862,131 of which the present application is a continuation-in-part. The tubular element 4 can be secured by press fit, or by a strap or band used in a fashion similar to a hose clamp to securely engage the tubular element with the exhaust pipe, by other suitable securing methods.

After the cap is mounted on the exhaust pipe in the manner described, it is ready to perform its function. The function of the exhaust cap is to prevent the entry into the exhaust pipe of dust, debris or rain so as to cause an undersirable accumulation of these contaminants at the bottom of the exhaust pipe and in, or adjacent, the exhaust ports of the engine, thus impairing engine operation. This influx of dust, rain or other contaminants into the interior of the exhaust pipe is particularly deloterious in its effect upon turbochargers where such are used as a part of the diesel power plant.

The exhaust cap of the invention is suitable for use on substantially any exhaust pipe used on diesel generator devices or on diesel power plants.

Another important consideration and desideratum in the utilization and effective functioning of exhaust caps employed on diesel engine exhaust pipes is that the caps open freely and sufficiently fully at a time when the engine is operating and exhaust gases are being vented to the atmosphere that either no back pressure, or an acceptably low amount of back pressure, is developed within the exhaust pipe as a result of the impediment to flow of exhaust gases afforded by the exhaust cap.

It is also important in the case of tractors having turbochargers that the cap not blow open at a time when the inactive tractor is being hauled over the road at a high speed on a flat truck bed or the like. If the cap blows open during this time, a sufficient amount of air pressure can be developed downwardly in the exhaust pipe by the wind action to spin the turbocharger. If this occurs when the engine is not running, it can seriously damage the turbocharger. This danger is especially a concern at a time when the truck carrying the tractor having a turbocharged engine is proceeding at a high rate of speed, and directly into a wind which is blowing in an opposite direction with a substantial force. In some practices used for avoiding this problem in the past, provision has been made for pinning the pivotally mounted exhaust pipe cap closed at a time when the engine is not operating. The failing of this method has been that personnel charged with the care of the engine, or with the transport of the tractor or diesel generator which is involved, have not been careful to pin the cap in its closed position before transport or wind force exposure.

In the case of the dynamically balanced protective cap of the present invention, once the tubular element 4 has been mounted on the exhaust pipe, the cap is oriented so that it faces the forward end of the tractor or engine as it faces left in FIG. 1. Thus, the forward side 6 of the tubular member 4 faces forwardly and the rear side 8 faces rearwardly. The tractor or engine carrying the exhaust pipe will normally be supported on a transporting truck so that the forward end of the vehicle upon which it is carried will be toward the left in FIG. 1, and when the flap assembly 18 pivots to an open position, as shown in dashed lines in FIG. 1, the flap assembly will be pivoting away from the forward end of a truck or other vehicle on which the engine or tractor carrying the engine is mounted.

Under this condition, the wind caused by movement of the carrying vehicle impinges against the wind vanes 46 and 48 in a direction such that a force is applied to the closure flap assembly which makes it remain seated in its closed position. This direction of wind flow at this time is shown by the arrow, W, in FIG. 1. If, on the other hand, the engine having the exhaust pipe to which the protective cap is mounted is turned in the opposite direction on the bed of the carrying truck, then the wind force which impinges upon the closure flap assembly 18 acts in the opposite direction from the direction of the action indicated by the arrow "W" in FIG. 1. The wind in this case will exert closing force on the large area of the closure plate 20 which is exposed thereto. This large area is illustrated best in FIGS. 4 and 5 of the drawings. The surface area here exposed to impingement by the wind is greater than that exposed surface area which is represented by the combined areas of the wind vanes 46 and 48. The flap assembly 18 will therefore also remain closed at this time.

When a diesel engine having an exhaust pipe is in operation, and the protective cap is installed, the geometry of the protective cap is such that the cap swings easily about the pivotal axis which is projected along the axis of the stub axles 40 and 42, and it moves to the open position illustrated in dashed lines in FIG. 1. The protective cap of the invention is constructed so that the closure plate 20 and the horizontally extending lip 22 thereof need only move a short distance from the "at rest" position, shown in full lines of FIG. 1, to the fully opened position shown therein by the dashed lines. This is because of the angulated opening across the top of the tubular member 4. Preferably, pivotation through an angle of from 30° to about 45° is all that is required to achieve the fully open position. It thus does not require a great deal of exhaust gas pressure to raise the closure flap assembly to this extent, and to thereby achieve full opening of the exhaust pipe to the atmosphere. There is very little back pressure developed in the course of moving the closure flap assembly 18 to the fully opened position. Further, with the closure flap assembly 18 in this opened position, the balance and center of gravity location of the entire structure is such that there is little inclination of the closure flap assembly to chatter, or to rapidly open and close so that the assembly becomes worn out in a short period of time.

The stub axles 40 and 42, in conjunction with the arresting bracket 32, are heavy, strong structures providing a pivotal mounting assembly of high mechanical strength. This construction, together with the dynamic balancing of the flap assembly which prevents it from chattering, or rapidly opening and closing, greatly extend the service life of the protective cap of the invention, and prevent it from becoming ineffective after a short period of operation of the diesel engine upon which the protective cap is utilized.

During the utilization of the dynamically balanced exhaust pipe cap, carbon and soot has a tendency to build up on the under side of the closure plate 20 at a location above and to the right of the stub axles and between the downwardly extending, trapezoidally-shaped balancing plates 28 and 30. As carbon builds up at this location over extended periods of use, the closure flap assembly 18 tends to not completely close. If the upper edge portions of the tubular element 4 were not cut to lie in two planes angled to each other the closure plate 20 would lie across, and in contact with, the rear of the upper edge of the tubular element 4, and would be propped open by reason of the accumulation of carbon and soot adjacent the rear side thereof.

The relief afforded by the angulation of the second upper edge portion 15 with respect to the first upper edge portion 14, so as to provide the illustrated space or gap between the second or rear upper edge portion 15 and the under side of the plate 20, accommodates a slight build up of carbon which may occur over an extended period of usage, and yet allow the closure flap assembly 18 to be completely closed. It has been our experience that any tendency of the carbon and soot to build up to an even greater extent, such that the closure flap assembly will still be propped open, is overcome by the inability of the carbon agglomeration at this location to grow to such an extent. In other words, the carbon cake will fragment or break away before it builds up to the point where the slot developed by the angulation of the rear edge portion 15 with respect to the first edge portion 14 is not sufficient to accommodate the carbon cake. This is an important feature of the present invention since, as will be understood by those familiar with the problems posed by many of the types of presently available exhaust pipe caps, even a slightly open closure flap assembly 18 will permit rain to enter the upper end of the tubular member 4, and the deleterious effect hereinbefore described will occur.

Although a preferred embodiment of the invention has been herein described in order to afford those having ordinary skill in the art a clear understanding of the operating principals on which the invention is based, it will be understood that various changes and innovations can be effected in the described structure without departure from the basic principles which underlie the invention. Changes and innovations of this type are therefore deemed to be circumscribed by the spirit and scope of the invention, except as the same may be necessarily limited by the appended claims or reasonable equivalents thereof.

What is claimed is:

1. A dynamically balanced protective cap for the exhaust stack of an internal combustion engine comprising:

a tubular element having an open lower end and an open upper end; and a closure flap assembly pivotally secured to said tubular element, and including:

a closure plate having a major closure portion of relatively large surface area extending across, and closing, said opening at the upper end of said tubular element when said plate is in a closing position;

a pair of horizontally spaced, parallel balancing plates disposed on opposite sides of said tubular element and each having one edge secured to one side edge of said closure plate, said balancing plates projecting from said closure plate downwardly away from said opening at the upper end of said tubular element, and positioned alongside said tubular element; and a pair of spaced wind vanes located on opposite sides of said tubular element and each secured to one of said balancing plates, and each positioned to extend into the path of air flow extending normal to the axis of said tubular element; and means pivotally supporting the closure flap assembly on said tubular element for pivotation about an axis extending through said balancing plates wherein a major portion of each of said balancing plates lies on the opposite side of said pivotal axis from said wind vanes.

2. A dynamically balanced protective cap as defined in claim 1 wherein the open upper end of said tubular element is slanted so as to lie at an angle to the axis of said tubular element, said open upper end including upper edge portions around the opening at the upper end of the tubular element, said upper edge portions including a first upper edge portion lying in a plane extending at an acute angle to the axis of said tubular element, and a second portion lying in a plane intersecting said first plane at an angle of from about 5° to about 10° and extending downwardly from said first plane so that second upper edge portion defines a gap between said tubular element and said closure plate when said closure plate is closed, whereby carbon build up on said closure plate does not prop said closure plate in an open position.

3. A dynamically balanced protective cap as defined in claim 1 wherein said means pivotally supporting said closure flap assembly on said tubular element comprises a U-shaped arresting bracket having a web portion and a pair of spaced, parallel legs at opposite ends of said web portion, said legs being located on opposite sides of said tubular element and each secured thereto, said web portion extending across said tubular element parallel to a tangent thereof; and stub axles extending into said leg portions and into said balancing plates to support said closure flap assembly on said arresting bracket for pivotation about a horizontal axis lying in a plane extending normal to the axis of said tubular element.

4. A dynamically balanced protective cap as defined in claim 3 and further characterized as including a stud secured to one of said balancing plates at a position thereon to contact said arresting bracket when said closure plate has been pivoted upwardly to an open position, and thereby prevent further opening movement of said closure plate.

5. A dynamically balanced protective cap as defined in claim 3 wherein the open upper end of said tubular element is slanted so as to lie at an angle to the axis of said tubular element, said open upper end including upper edge portions around the opening at the upper end of the tubular element, said upper edge portions including a first upper edge portion lying in a plane extending at an acute angle to the axis of said tubular element, and a second upper edge portion lying in a plane intersecting said first plane at an angle of from about 5° to about 10° so that said second edge portion defines a gap between said tubular element and said closure plate when said closure plate is closed whereby a carbon build up on said closure plate does not prop said closure plate in an open position.

6. A dynamically balanced protective cap as defined in claim 5 and further characterized as including a stud secured to one of said balancing plates at a position thereon to contact said arresting bracket when said closure plate has been pivoted upwardly to an open position, and thereby prevent further opening movement of said closure plate.

7. A dynamically balanced protective cap for fitment on the exhaust pipe of an internal combustion engine comprising:

an elongated, tubular element having an angulated bias cut defining a slanted opening at one end of the tubular element, said slanted opening being defined and surrounded by a pair of edge portions lying in two different, intersecting planes, one of said planes extending at an acute angle of from about 5° to about 10° to the other of said planes; and a closure flap assembly pivotally mounted on said tubular element for pivotation between an open and a closed position, and including:

a closure plate having a closure portion extending in one of said planes when said closure flap assembly is in its closed position and then contacting one of said edge portions of said tubular element surrounding said opening at said one end thereof where that one edge portion lies in said one plane, and projecting in said one plane to a location over, and spaced from, said second edge portion to provide an opening for egress of exhaust gas through said opening when said closure plate is closed across said one end of said tubular element;

a pair of horizontally spaced balancing plates disposed on opposite sides of said tubular element and each having one edge secured to one side edge of said closure plate, said balancing plates projecting from said closure plate away from said opening at one end of said tubular element; and a pair of spaced wind vanes each secured to one of said balancing plates and each positioned to extend into the path of air flow normal to said tubular element, and located on opposite sides of said tubular element and extending in a direction away from said tubular element; and means secured to said tubular element and pivotally supporting the closure flap assembly on said tubular element for pivotation about an axis extending through said balancing plates and lying in a plane extending normal to the axis of said tubular element.

8. A dynamically balance protective cap as defined in claim 7 wherein said means pivotally supporting the closure flap assembly comprises a U-shaped arresting bracket secured to said tubular element; and axle means pivotally securing said closure flap assembly to said U-shaped arresting bracket.

9. A dynamically balanced protective cap as defined in claim 7 wherein said closure plate includes a pair of lateral flanges located at opposite sides thereof, said lateral flanges each including one of said side edges to which one of said balancing plates is secured.

10. A dynamically balanced protective cap as defined in claim 7 wherein said wind vanes lie in a common plane and extend perpendicular to the planes in which said horizontally spaced balancing plates are located.

11. A dynamically balanced protective cap as defined in claim 7 wherein a major portion of each of said balancing plates lies on the opposite side of said pivotal axis from said wind vanes.

12. A dynamically balanced protective cap as defined in claim 11 wherein said wind vanes lie in a common plane and extend perpendicular to the planes in which said horizontally spaced balancing plates are located.

13. A dynamically balanced protective cap as defined in claim 12 wherein said closure plate includes a pair of lateral flanges located at opposite sides thereof, said lateral flanges each including one of said side edges to which one of said balancing plates is secured.

14. A dynamically balanced protective cap as defined in claim 13 wherein said means pivotally supporting the closure flap assembly comprises a U-shaped arresting bracket secured to said tubular element; and axle means pivotally securing said closure flap assembly to said U-shaped arresting bracket.

15. A protective cap adapted to be slidingly and telescopingly engaged with a tubular exhaust stack, said protective cap comprising:

a tubular element for telescopingly and slidingly engaging the exhaust pipe and having an open upper end, and an open lower end;

a closure flap assembly pivotally secured to said tubular element, and including:

a closure plate lying across, and closing, the opening at the upper end of said tubular element when said closure plate is in a closed position, and extending upwardly over the opening at the upper end of said tubular element when said closure plate is in an open position;

a pair of horizontally spaced, parallel, balancing plates of generally trapezoidal configuration disposed on opposite sides of said tubular element, and each of said balancing plates having an upper edge portion secured to one side edge of said closure plate, said balancing plates projecting from said closure plate downwardly and away from the opening at the upper end of said tubular element; and a pair of spaced wind vanes in coplanar alignment with each other, and each secured to, and extending normal to the plane of, one of said balancing plates, and each positioned to extend in the path of air flow normal to said tubular element, said spaced wind vanes being located on opposite sides of said tubular element and extending in a direction away from said tubular element; and means pivotally supporting the closure flap assembly on said tubular element for pivotation about an axis extending through said balancing plates at a location such that a major portion of each of said balancing plates lies on the opposite side of said pivotal axis from said wind vanes.

* * * * *